US006692800B1

(12) United States Patent
Jacobs

(10) Patent No.: US 6,692,800 B1
(45) Date of Patent: Feb. 17, 2004

(54) METHOD OF REDUCING MIGRATION OF ALDEHYDE COMPOUNDS IN PACKAGING

(75) Inventor: Stephen Alan Jacobs, Palatine, IL (US)

(73) Assignee: The Quaker Oats Company, Chicago, IL (US)

( * ) Notice: Subject to any disclaimer, the term of this patent is extended or adjusted under 35 U.S.C. 154(b) by 61 days.

(21) Appl. No.: 09/696,620

(22) Filed: Oct. 25, 2000

Related U.S. Application Data

(63) Continuation of application No. 08/990,830, filed on Dec. 15, 1997, now abandoned.

(51) Int. Cl.[7] ..... B29D 22/00; B32B 1/08

(52) U.S. Cl. ..... 428/34.2; 428/526; 428/530; 428/533; 427/372.2; 427/388.3; 427/385.5; 427/458; 427/421; 427/430.1

(58) Field of Search ..... 428/34.2, 526, 428/530, 533; 427/372.2, 388.3, 385.5, 458, 421, 430.1

(56) References Cited

U.S. PATENT DOCUMENTS

| | | | | | |
|---|---|---|---|---|---|
| 3,293,057 | A | * | 12/1966 | Rumberger | 106/214.2 |
| 3,352,705 | A | * | 11/1967 | Moes | 106/210.1 |
| 3,511,744 | A | * | 5/1970 | Garrett, Jr. | 162/109 |
| 4,157,318 | A | * | 6/1979 | Sadle et al. | 106/214.2 |
| 4,377,649 | A | * | 3/1983 | Sweeney et al. | 156/328 |
| 4,623,412 | A | * | 11/1986 | Bohme et al. | 156/210 |
| 4,775,706 | A | * | 10/1988 | Iovine et al. | 156/326 |
| 4,855,354 | A | * | 8/1989 | Mohler et al. | 156/205 |
| 5,079,067 | A | * | 1/1992 | Willging | 428/182 |
| 5,458,723 | A | * | 10/1995 | Watkins et al. | 156/310 |
| 5,618,632 | A | * | 4/1997 | Watkins et al. | 428/34.2 |
| 5,627,261 | A | * | 5/1997 | Albrecht et al. | 524/843 |
| 5,789,010 | A | * | 8/1998 | Behan et al. | 426/534 |

FOREIGN PATENT DOCUMENTS

| | | | |
|---|---|---|---|
| EP | 526977 | * | 2/1993 |
| EP | 540098 | * | 5/1993 |
| EP | 794053 | * | 9/1997 |

* cited by examiner

*Primary Examiner*—Kenneth R. Rice
(74) *Attorney, Agent, or Firm*—Ryndak & Suri

(57) ABSTRACT

A method for reducing the migration of aldehyde compounds present in packaging material the interior of a package formed by said packaging material, said method comprising: (a) selecting an initial packaging sheet stock used for forming a package having an interior in which an aldehyde sensitive product can be contained, wherein said initial packaging sheet stock has a first surface that forms the interior wall of said formed package, wherein said initial packaging sheet stock has a second surface that forms the exterior wall of said formed package, and wherein said initial packaging sheet stock contains one or more aldehyde compounds that are capable of migrating from said initial packaging sheet stock to said package interior or exterior; (b) preparing an amine-containing composition comprising an amine that chemically reacts with said aldehyde compounds to form a substantially non-migrating compound; and (c) applying said amine-containing composition onto said first surface of said initial packaging sheet stock in a manner such that the amount of said amine applied to said first surface is at least a molar amount stoichiometrically necessary to chemically react with substantially all of said aldehyde compounds present in said initial packaging sheet stock that are capable of migrating from said initial packaging sheet stock to said package interior or exterior, thereby forming a coated packaging material.

26 Claims, No Drawings

METHOD OF REDUCING MIGRATION OF ALDEHYDE COMPOUNDS IN PACKAGING

This application is a continuation of application Ser. No. 08/990,830 filed on Dec. 15, 1997abandoned.

FIELD OF INVENTION

The present invention relates to a method for reducing the migration of aldehyde compounds found in packaging materials to the contents of packages made from such packaging materials. The present invention also relates to a package made from packaging material containing aldehyde compounds, wherein the migration of the aldehyde compounds found in the packaging material to the interior of the package is reduced. The invention still further relates to an improved paperboard packaging material prepared from recycled paper stock, wherein the recycled paper stock contains aldehyde compounds and amines to react with said aldehyde compounds, thereby preventing or slowing the migration of the aldehyde compounds from the paperboard packaging material when formed into a package.

BACKGROUND OF INVENTION

In recent years, the use of recycled materials to prepare packages has become much more prevalent than in the past. This increased recycling activity has been driven primarily by two factors: cost/economics and environmental concerns. The types of materials that are recycled include plastics, steel, and papers.

The use of recycled materials in preparing packages does cause several problems, however. One such problem is that recycled materials often contain impurities that are not found in virgin raw materials. For example, paperboard made from recycled paper stock typically contains aldehyde compounds. These aldehyde compounds are present in the recycled paper stock due to inks that are present in the original paper being recycled, and are not present in paper made from virgin stock.

These impurities in the recycled materials can, in certain instances, cause problems in the final package prepared from the recycled materials. For example, it has been found that when packages that contain food products are prepared using recycled paper stock that contains aldehyde compounds, the aldehydes can migrate from the recycled paper stock and into the package interior, where the product is stored. This migration, or transport, of the aldehyde compounds is undesirable because the aldehyde compounds impart off flavors and off odors to the food product when they come in contact with the food product.

The present invention provides a method for reducing this migration of such aldehyde compounds to the interior of the formed package. In the provided method, amine compounds are applied to the surface of the packaging material that forms the interior of the formed package. The amine compounds chemically react with aldehyde compounds that migrate through the packaging material, thereby forming a relatively chemically inert and less volatile compound. This chemical reaction slows or prevents the further migration of the aldehyde compounds to the interior of the package formed from the packaging material. The present invention further provides a package prepared from packaging materials containing aldehyde compounds, wherein the migration of the aldehyde compounds to the interior of the formed package is reduced or prevented.

BACKGROUND ART

The background art teaches urea-containing compositions. U.S. Pat. No. 3,293,057, issued Dec. 20, 1966, to Rumberger, claims a composition prepared by mixing together and reacting at an elevated temperature an aqueous dispersion of individual ingredients comprising starch, urea, and a polyfunctional aldehyde, wherein said starch is present in an amount of about 9% to about 95% by weight, said urea is present in an amount of about 5% to about 80% by weight, and said aldehyde is present in an amount of about 0.5% to about 20% by weight, all based on the total solids weight of said compositions, the pH of said dispersion being no greater than about 7.

The art also teaches compositions containing urea-aldehyde reaction products. U.S. Pat. No. 4,623,412, issued Nov. 18, 1986, to Bohme et al., claims a process for producing a resin impregnated linerboard for use in the production of corrugated board, wherein the surfaces of said resin impregnated linerboard have substantially no resinous material thereon. The claimed process comprises, in sequence: (i) providing an aqueous impregnating composition comprising (a) urea-aldehyde resin, (b) a catalyst, (c) a wetting agent, and (d) from 0to about 20% of a solvent, thereby providing a linerboard substrate; (ii) applying said aqueous impregnating composition to at least one surface of said linerboard substrate to form a coating thereon; (iii) applying an aqueous primer onto said coating of said impregnating composition such that said aqueous primer causes said impregnating composition to permeate said linerboard substrate to provide said linerboard substrate with a substantially polymeric core and having substantially no resinous material on the surfaces thereof; (iv) drying said impregnated linerboard under conditions for fully curing said urea-aldehyde resin to provide said linerboard with a substantially solid resinous core and having surfaces substantially free of said urea-aldehyde resin; (v) remoistening said fully cured linerboard; and (vi) passing the remoistened linerboard to a corrugator for incorporation into the corrugated board.

U.S. Pat. No. 4,377,649, issued Mar. 22, 1983, to Sweeney et al., claims a composition for use in the manufacture of cellulosic fiber materials, which comprises (a) from 1 to 50 wt % of a wax, (b) from 1 to 30 wt % of a starch, (c) from 1 to 50 wt % of a formaldehyde based resin, and (d) a liquid carrier.

U.S. Pat. No. 3,352,705, issued Nov. 14, 1967, to Moes et al., claims a method of producing a water resistant amylaceous pigment coating on paper or paperboard which comprises applying to said paper or paperboard a pigmented aqueous solution of a starch derivative, obtained by hydrolyzing starch at a temperature of between 60 and 300° C. with an inorganic acid in the presence of urea in an amount of from 5 to 50% by weight, calculated on the basis of starch used, and less than 50% of water, calculated on the weight of the mixture, to such an extent that a 25% aqueous solution of the starch derivative has an apparent viscosity not lower than 10 centipoise at 25° C., and reacting said starch derivative with an aldehyde reagent capable of rendering the same insoluble, said aldehyde reagent being selected from the group consisting of said aldehydes, aldehyde donors and melamine-aldehyde precondensates, and the pH during the insolubilization reaction being from about 6 to about 9.

U.S. Pat. No. 4,775,706, issued Oct. 4, 1988, to lovine et al., claims a water-resistant, alkaline curing corrugated adhesive composition comprising: (i) from about 66–35%, based on total weight of the adhesive, solids basis, of a polymer present in latex form, prepared by polymerizing a halohydrin quaternary ammonium monomer and a vinyl polymerizable monomer; (ii) from about 10–50% based on total weight of the adhesive of a starch component comprising ungelatinized starch or a mixture of ungelatinized and gelatinized starch; (iii) from about 40–80%, based on total weight of the adhesive, of water; and (iv) sufficient alkali to provide the adhesive with a pH of about 7.5 to 13.

U.S. Pat. No. 4,855,354, issued Aug. 8, 1989, to Mohler et al., claims a curable composition of matter which consists of: (a) a starch-aldehyde resin mixture, said mixture being formed by mixing said starch and said aldehyde resin; (b) a curing agent capable of reducing the pH of the composition, wherein said curing agent is present in an amount sufficient to accelerate the cure of the composition; and (c) a solvent selected from the group consisting of water, methanol, ethanol, isopropyl alcohol and mixtures thereof; wherein the ratio of aldehyde resin to starch is from 7:5 to 5:1 by weight.

U.S. Pat. No. 3,511,744, issued May 12, 1970, to Garrett, claims a method of producing sag-resistant fiberboard comprising the steps of forming fiberboard having at least two primary surfaces, each of which being located on a side of the board opposite from the other, coating at least a portion of one of said surfaces with a sag-resistant means which helps the fiberboard resist moisture and prevents expansion of the opposite surface to result in the sagging of the fiberboard, drying said fiberboard in part, then abrasively treating at least a portion of one of said surfaces other than said coated surface to at least partially stress relieve said board by removing the crust portion on the surface of the board formed by the drying of the fiberboard, whereby the fiberboard, which is abrasively treated on one side and coated with a sag-resistant means on the opposite side, will be cupped in the direction of the abrasively treated side.

The art also teaches applying a urea-containing adhesive to corrugated paperboard. U.S. Pat. No. 4,157,318, issued Jun. 5, 1979, to Sadle et al., claims an adhesive composition adapted for use as a bonding agent for corrugated paperboard upon being subjected to heat in situ. This adhesive composition contains a carrier comprising 1 part gelatinized amylaceous material, between about 3 and 5 parts water, and between about 0.5 and 4 parts urea, said carrier, in the absence of caustic, being adapted to reduce the temperature at which bonding will take place to within the range of about 140°–155° F.

However, none of the background art teaches applying an amine-containing composition to an aldehyde-containing packaging sheet stock used to prepare a food-containing package. Nor does the art teach that the application of such amine-containing composition to such stock will act to reduce or prevent the migration of such aldehyde compounds from the stock to the interior of the food-containing package prepared from such stock. Nor does the art teach an improved aldehyde-containing packaging sheet stock used to prepare a food-containing package, wherein the improvement comprises preparing the packaging sheet stock with amine compounds contained in the packaging sheet stock, or that the inclusion of such amine compounds in such packaging sheet stock will reduce or prevent the migration of aldehyde compounds from the stock to the interior of the food-containing package prepared from such stock.

It is therefore an object of the present invention to provide a package, especially a food package, that is prepared from material containing aldehyde compounds, wherein the migration of the aldehyde compounds from the material used to make the package and into the package interior is reduced or prevented. It is also an object of the present invention to provide a method for reducing or preventing the migration, or transport, of aldehyde compounds from the material used to make a package into the package interior.

These objects are accomplished by the invention described herein.

SUMMARY OF THE INVENTION

The present invention relates to a method for reducing or preventing the migration of aldehyde compounds present in packaging material to the interior of a package formed by said packaging material, said method comprising:

(a) selecting an initial packaging sheet stock that can be used to form a package having an interior in which an aldehyde sensitive product can be contained, wherein said initial packaging sheet stock has two primary surfaces, a first surface that forms an interior wall of said package and a second surface located on an opposite side of the initial packaging sheet stock from the first surface, wherein said second surface forms an exterior wall of said formed package, and wherein said initial packaging sheet stock contains one or more aldehyde compounds that are capable of migrating from said initial packaging sheet stock to said package interior or exterior;

(b) preparing an amine-containing composition comprising an amine that chemically reacts with said aldehyde compounds to form relatively unreactive or lower volatility compounds; and (c) applying said amine-containing composition onto said first surface of said initial packaging sheet stock, thereby forming a coated packaging material.

The present invention further relates to an improved paperboard material prepared from recycled paper that can be used to form a package having an interior in which an aldehyde sensitive product can be contained, wherein said paperboard packaging sheet stock has two primary surfaces, a first surface that acts to form an interior wall of said package, and a second surface located on an opposite side of the paperboard packaging sheet stock from the first surface, wherein said second surface forms an exterior of said package, and wherein said paperboard stock comprises an aldehyde compound selected from the group consisting of formaldehyde, isobutylaldehyde, hexanol, heptenal, and mixtures thereof, wherein the improvement comprises including in said paperboard stock an amine that chemically reacts with said aldehyde compounds to form substantially non-migrating relatively unreactive or lower volatility compounds.

The present invention still further relates to a package used for packaging aldehyde sensitive products, said package being prepared by the method comprising:

(a) selecting an initial packaging sheet stock that can be used to form a package having an interior in which an aldehyde sensitive product can be contained, wherein said initial packaging sheet stock has two primary surfaces, a first surface that forms an interior wall of said package, a second surface located on an opposite side of said initial packaging sheet stock from said first surface, wherein said second surface forms an exterior wall of said formed package, and wherein said initial packaging sheet stock contains one or more aldehyde compounds capable of migrating from said initial packaging sheet stock to said package interior or exterior;

(b) preparing an amine-containing composition comprising an amine that chemically reacts with said aldehyde compounds to form substantially non-migrating, relatively unreactive or lower volatility compounds;

(c) applying said amine-containing composition onto said first surface of said initial packaging sheet stock, thereby forming a coated packaging material;

(d) drying said coated packaging material, as necessary, to a moisture content in the range acceptable and known in the art for packaging materials; and (e) forming said coated packaging material into a package having an interior in which an aldehyde sensitive product can be contained, wherein said package is formed in such a manner that said first surface forms said interior of said package.

DETAILED DESCRIPTION OF THE INVENTION

The present invention is directed to a method for reducing or preventing the migration of aldehyde compounds present in packaging material to the interior of a package that is formed by the packaging material. In the present invention the material used to prepare packages includes or contains aldehyde compounds. These aldehyde compounds are undesirable if they are able to migrate from the packaging material into the interior of the package formed by the packaging material. This is undesirable for a number of reasons. For example, when food is contained in the package formed by the packaging material, any aldehyde compounds that migrate into the interior of the package and come in contact with the food will impart off flavors and/or off odors to the food. Of course, this is undesirable for consumers. This is especially a problem when recycled paper is used as the raw material for forming the packaging material. Since the original paper used for preparing the recycled paper stock has printing on it, the recycled paper will contain these inks.

These printed inks contain aldehydes, which will therefore be present in the recycled packaging paper.

In the method of the present invention, an initial packaging sheet stock, preferably sheet stock, is selected which contains one or more aldehyde compounds that are capable of migrating from the initial packaging sheet stock to the package interior or exterior. By "capable of migrating" it is meant that the aldehyde compounds are not chemically or physically prevented from migrating from the packaging sheet stock into the interior. The technology of the present invention is not necessary for packaging sheet stock that does not contain aldehydes or where the aldehyde contained in the stock is not "capable of migrating."

The aldehyde compounds typically found in the initial packaging sheet stock of the present invention include, but are not limited to, formaldehyde, isobutylaldehyde, hexanol, heptenal, and mixtures thereof. The concentration of such aldehyde compounds in the packaging sheet stock will depend upon what the packaging material is made from or what printing techniques have been used to prepare the packaging sheet stock.

By "packaging sheet stock" it is meant raw material that may be used to produce the package which is typically in the form of a sheet. The initial packaging sheet stock may be made from paper stock, recycled paper stock, or other known sources. When the initial packaging sheet stock is recycled paper sheet stock, it may contain various concentrations of aldehyde compounds.

The initial packaging sheet stock of the present invention is used to form a final package which has an interior in which an aldehyde sensitive product can be contained. The formed packages have an interior and an exterior, with an aldehyde sensitive product being contained in the interior. By "aldehyde sensitive product" it is meant a product that is degraded in some fashion when contacted with aldehyde compounds. For example, when food products are brought into contact with aldehyde compounds, they develop off flavors and/or off odors. The aldehyde sensitive products that can be packaged in the packages formed in the present invention may include virtually any type of food product.

The package may be formed by any equipment and any method known to those skilled in the art for forming packages for the particular packaging sheet stock being used.

The initial packaging sheet stock used in the present invention has two primary surfaces located on opposite sides of the stock, a first surface and a second surface. The first surface forms an interior wall of the package formed from the packaging material. The second surface forms the exterior wall of the formed package. The first and second surfaces are on opposite sides of the initial packaging sheet stock.

Separately from selecting the initial packaging sheet stock, an amine-containing composition is prepared which is applied to the initial packaging sheet stock. The amine-containing composition comprises an amine that will chemically react with the aldehyde compounds contained in the initial packaging sheet stock to form a chemical reaction product. The reaction product formed by the reaction of the amine with the aldehyde is relatively stable in that it reduces or prevents any migration of the aldehyde contained in the initial packaging sheet stock into the interior of the package formed by the sheet stock over the shelf lives of both the package and the aldehyde sensitive product contained in such package.

Preferably, the minimum amount of amine present in the amine-containing composition is the molar amount that is stoichiometrically necessary to chemically react with substantially all of the aldehyde compounds that are both present in the initial packaging sheet stock and are free to migrate from the initial packaging sheet stock to the package interior or exterior.

The amine-containing composition may be in the form of a dry powder or in a liquid form, preferably in the form of a liquid composition. The exact form which the amine-containing composition will take will depend upon the method that is used to apply the amine-containing composition to the initial packaging sheet stock and the particular initial packaging sheet stock used.

The preferred liquid amine-containing composition comprises an amine and a liquid carrier, or vehicle for the amine. In a preferred embodiment, the amine may be added to a starch solution which is to be sprayed onto the surface such as during a sizing operation. The liquid amine-containing composition comprises a liquid carrier selected from the group consisting of water, starch solutions, oil, and mixtures thereof, with the starch solution being more preferred. For the more preferred starch solution amine-containing composition, the composition comprises from about 0.1% to about 10%, preferably from about 0.3% to about 7%, more preferably from about 0.5% to about 5% by weight amine.

The amine contained in said amine-containing composition may be any amine known to those skilled in the art as being capable of chemically reacting with the aldehyde compounds contained in the initial packaging sheet stock. The particular type of amine that is used in the present invention may also be dependent upon whether or not the amine-containing composition is in the form of a dry composition, a liquid composition, or the more preferred starch solution composition, and the intended use of the formed package. For example, if the product that is to be packaged in the formed package is a food product, an amine that is acceptable for contact with food will be selected.

Examples of amine compounds useful in the present invention include, but are not limited to, urea, polyethylene amine, lysine, melamine, and mixtures thereof, with urea, and mixtures thereof being more preferred. In the preferred liquid amine-containing composition, examples of amines useful therein include, but are not limited to, urea, polyethylene amine, lysine, melamine, and mixtures thereof.

For the preferred liquid amine-containing composition, when the amine compound is selected from the preferred urea, polyethylene amine, lysine, melamine, and mixtures thereof, the liquid amine-containing composition comprises from about 0.1% to about 10%, preferably from about 0.3% to about 7%, more preferably from about 0.5% to about 5% by weight amine, and a liquid carrier selected from the group consisting of water, starch solutions, oil, and mixtures thereof, with the starch solution being more preferred. In the more preferred aqueous composition, when the amine is the more preferred urea, polyethylene amine, lysine, melamine, and mixtures thereof, the aqueous composition comprises from about 0.1% to about 10%, more preferably from about 0.3% to about 7%, still more preferably from about 0.5% to about 5% by weight amine.

When the initial packaging sheet stock is prepared from recycled paperboard, and contains the more typical aldehyde compounds of formaldehyde, isobutylaldehyde, hexanol, or heptenal, the aqueous amine-containing composition will comprise from about 0.1% to about 10%, more preferably from about 0.3% to about 7%, still more preferably from about 0.5% to about 5% by weight of the preferred amine consisting of urea, lysine, melamine, and mixtures thereof.

The amine-containing composition may contain other optional ingredients as well. As will be appreciated by those skilled in the art, the particular type of optional ingredients included therein will depend upon the form of the particular amine-containing composition, and the desired functionality of the optional ingredient. For example, if the amine-containing composition is a liquid composition, it may contain optional ingredients that may not necessarily be useful in a dry amine-containing composition. Additionally, if the liquid amine-containing composition comprises a vehicle or carrier that is other than water, e.g., an organic solvent, then it may contain optional ingredients that may not necessarily be compatible with water, and vice-versa. Additionally, the functionality desired for the optional ingredient will also impact which type of optional ingredients are included in the amine-containing composition. For example, if one desired to impart water-proofing properties to the packaging sheet stock, then an ingredient would be selected to impart such water-proofing properties to the final package. In either case, care must be taken when selecting optional compounds to insure that no optional compounds are selected that will interfere with the desired chemical reaction between the amines and the aldehyde compounds contained in the initial packaging sheet stock.

After the amine-containing composition is prepared, it is applied to the first surface of the initial packaging sheet stock, thereby forming a coated packaging material. Preferably, the amine-containing composition is applied in a manner such that the amount of amine applied is at least an amount that is stoichiometrically necessary to chemically react with substantially all of the aldehyde compounds that are both present in the initial packaging sheet stock and are able to migrate from the initial packaging sheet stock to the package interior or exterior.

Preferably, the amine-containing composition is applied to the first surface in such a manner so that there will be a substantially uniform coating of the first surface with the amine-containing composition. More preferably, the amine-containing composition is applied to the first surface in a manner such that the amine contained in the coating composition coats substantially the entire first surface. This is to provide sufficient reactive sites for aldehyde compounds migrating through the initial packaging sheet stock. By providing sufficient reactive sites, i.e., amines that can react with migrating aldehyde compounds, this will ensure that the number of aldehyde compounds that pass from the initial packaging sheet stock into the interior of the packaging formed by the sheet stock will be minimal or zero. While it is not absolutely necessary to have a substantially uniform and complete covering of the first surface of the initial packaging sheet stock with amines, the greater the coverage of the amines on the first surface, the greater the reduction in aldehyde transmission to the package interior. As such, it is preferred that the packaging surface be substantially uniformly and completely covered with amine compound.

The particular method of applying the amine-containing composition to the first surface will depend upon the form of the amine-containing composition, i.e., whether or not the amine-containing composition is a dry powder or a liquid composition. In either case, one skilled in the art will appreciate the method, manner, and equipment necessary to apply the amine-containing composition to the first surface. Of course, the particular method being used to apply the amine-containing composition to the first surface will also depend upon which type of material the initial packaging sheet stock is made from. As an example, it may be possible to apply a dry powder amine-containing composition to a plastic substrate through methods such as electro-deposition. For the preferred liquid amine-containing composition, examples of preferred application methods include, but are not limited to, spray application, immersion, or rolling on, with spraying being more preferred. For the more preferred aqueous amine-containing composition, the aqueous amine-containing composition may be applied to the first surface by spraying, immersion, or rolling on, with spraying being more preferred. In one preferred method, the food grade amine may be added to a starch solution which may be applied to the sheet stock for other purposes, such as sizing of the material. In this way, there is no need for an additional step to be added to the normal processing of the sheet stock.

In any application method used in the present invention, care must be taken to avoid applying the amine-containing composition in such a manner that will either inactivate the amine compound such that it will not chemically react with any aldehyde compounds contained in the initial packaging sheet stock, or applying the amine-containing composition in a manner that it will not be able to react with the aldehyde compounds contained in the initial packaging sheet stock.

After the amine-containing composition is applied to the first surface of the initial packaging sheet stock, thereby forming a coated packaging material, the coated packaging material may be used to form a package having an interior in which an aldehyde sensitive product may be contained. As already discussed herein, the package will be formed in such a manner so that the first surface comprises the interior wall of the formed package.

The present invention further relates to an improved paperboard stock prepared from recycled paper that can be used to form a package having an interior in which an aldehyde sensitive product can be contained. The improved paperboard stock has two primary surfaces, a first surface that acts to form an interior wall of said package, and a second surface located on an opposite side of the paperboard packaging sheet stock from the first surface, wherein the second surface forms an exterior of the package.

The improved paperboard stock comprises an aldehyde compound selected from the group consisting of formaldehyde, isobutylaldehyde, hexanol, heptenal, and mixtures thereof. When it is said that the improved paperboard stock comprises an aldehyde compound, it is meant that in the manufacturing process of the paperboard stock, aldehyde compounds are contained in the raw materials used to prepare the paperboard stock, and therefore, are contained within the paperboard stock itself. As already discussed herein, in the absence of the amine contained in the improved paperboard stock, such aldehyde compounds are capable of migrating from the improved paperboard stock to the interior of the package that is to be prepared from the paperboard stock.

The improvement in the paperboard stock comprises including in the paperboard stock an amine that chemically reacts with the aldehyde compounds to form subsubstantially non-migrating relatively unreactive or lower volatility compounds. As already discussed herein, by relatively unreactive compounds it is meant compounds that do not react or migrate further for the shelf life of both the packaging material and the aldehyde sensitive product contained therein. The amount of amine present in the improved paperboard stock is at least the molar amount that is stoichiometrically necessary to chemically react with substantially all of the aldehyde compounds.

The improved paperboard stock typically comprises from about 0.1% to about 10%, preferably from about 0.3% to about 7%, more preferably from about 0.5% to about 5% by weight of an amine compound selected from the group consisting of urea, lysine, melamine, with urea, and mixtures thereof being more preferred.

The amine is incorporated into the paperboard stock in its manufacturing process. Although the exact point in the manufacturing process at which the amine can be included is not precisely known, it would have to be at a point wherein the amine would not be rendered unreactive, or incapable of reacting with the aldehyde compounds contained in the paperboard stock. Furthermore, care must be taken in deciding where in the paperboard manufacturing process to include the amine compounds to ensure that a sufficient amount of amine remains in the final product. A description of methods and technology used to prepare paperboard stock is set forth in the Kirk-Othmer, Encyclopedia of Chemical Technology, 4th ed., vol. 18, pp. 1–25 (1996), John Wiley and Sons, Inc., New York, the disclosure of which is incorporated herein in its entirety.

The amines may be added to the paperboard manufacturing process either by adding the amines directly or by adding the amines in an aqueous or other composition or in a starch coating step. While it is believed that the latter is the most appropriate method of addition, it is uncertain which is the best method of addition.

While not intending to be bound by theory, it is surprising and unexpected that amine compounds can be used to chemically react with aldehyde compounds to prevent the migration of the aldehyde compounds to the interior of a package formed from packaging substrate, either by applying the amines to the packaging surface of the sheet material used to prepare or form the packages, or by incorporating the amines directly into the paperboard sheet material used to prepare or form the package.

What is claimed is:

1. An improved paperboard stock prepared from recycled paper that can be used to form a package having an interior in which an aldehyde sensitive product can be contained, wherein said paperboard packaging sheet stock has two primary surfaces, a first surface that acts to form an interior wall of said package, and a second surface located on an opposite side of the paperboard packaging sheet stock opposite from the first surface, wherein said second surface forms an exterior of said package, and wherein said paperboard material contains an aldehyde compound therein, wherein the improvement comprises including in said paperboard stock an amine that chemically reacts with said aldehyde compound to form a substantially non-migrating reaction product, wherein the minimum amount of said amine present in said paperboard stock is the molar amount stoichiometrically necessary to chemically react with substantially all of said aldehyde compound.

2. An improved paperboard stock according to claim 1, wherein said paperboard stock is sheet stock and wherein the minimum amount of said amine present in said paperboard stock is the molar amount stoichiometrically necessary to chemically react with substantially all of said aldehyde compound.

3. A method of reducing the migration of an aldehyde compound into the interior of a package made with a sheet stock material comprising paper and containing the migrating aldehyde compound in the paperboard comprising;

forming a coating on at least the surface of the sheet stock material that can form the interior of the package with a reactive amine compound that is chemically reactive in the coating with the migrating aldehyde compound to form a substantially non-migrating reaction product, so that at least some of the migrating aldehyde compound reacts with the reactive amine in the coating and does not migrate into the package.

4. A method according to claim 3, wherein said amine-containing composition comprises urea added to a liquid starch composition.

5. The method of claim 3 wherein the packaging sheet is prepared from material selected from the group consisting of paper stock, recycled paper stock and combinations thereof.

6. The method of claim 5 wherein the recycled paper stock comprises an aldehyde selected from the group consisting of formaldehyde, isobutylaldehyde, hexanol, heptenal and combinations thereof.

7. The method of claim 3 wherein the amine compound is selected from the group consisting of urea, polyethylene amine, lysine, melamine and combinations thereof.

8. The method of claim 3 wherein the reaction product is a substantially non-migrating reaction product.

9. The method of 16 wherein the amine compound is present in the coating in a stoichiometric amount sufficient to react with substantially all the aldehyde compound contained in the paperboard.

10. The method of claim 3 wherein said forming results in a uniform coating.

11. The method of claim 3 wherein the forming comprises applying to the surface an amine-containing composition comprising the amine compound and a liquid carrier.

12. The method of claim 11 wherein the carrier is selected from the group consisting of water, starch solution, oil and mixtures thereof.

13. The method of claim 11 wherein the amine-containing composition comprises from about 0.1% to about 10% by weight amine.

14. The method of claim 11 wherein the forming further comprises drying the amine-containing composition after said applying.

15. The method of claim 3 further comprising forming a package with the coated packaging material with the coating on the interior of the package.

16. The method of claim 15 further comprising placing a quantity of an aldehyde sensitive product in the package interior.

17. The method of claim 6 wherein said forming further comprises electro-depositing the amine-containing compound.

18. A packaging sheet stock product useful for forming a container for containing an aldehyde sensitive product comprising:

a sheet comprising paper and having a first surface and a second surface;

the sheet having a migratory aldehyde compound; and a coating on one of said first and second surfaces, said coating comprising a reactive amine compound that is chemically reactive with the migrating aldehyde compound to form a substantially non-migrating reaction product, so that at least some of the migrating aldehyde compound reacts with the reactive amine in the coating.

19. The packaging sheet stock product of claim 18 wherein the amine compound is present in an amount sufficient to react with substantially all the aldehyde compound.

20. The packaging sheet stock product of claim 18 wherein the coating further comprises a starch material.

21. The packaging sheet stock product of claim 18 wherein the packaging sheet is selected from the group consisting of paper stock, recycled paper stock and combinations thereof.

22. The packaging sheet stock product of claim 21 wherein the recycled paper stock contains a material selected from the group consisting of formaldehyde, isobutylaldehyde, hexanol, heptenal and combinations thereof.

23. The packaging sheet stock product of claim 18 wherein the amine compound is selected from the group consisting of urea, polyethylene amine, lysine, melamine and combinations thereof.

24. A package for containing an aldehyde sensitive product comprising:

a packaging sheet comprising paper and having opposing first and second surfaces, the first surface forming an interior package wall for contact with the aldehyde sensitive product and the second surface forming an exterior package wall, the packaging sheet containing migratory aldehyde compound capable of migrating into the interior package and contacting the aldehyde sensitive product; and a reactive amine compound associated with the packaging sheet, the amine compound being chemically reactive with the migratory aldehyde compound to form a substantially non-migrating reaction product and the amine compound present in an amount so that at least some of the migratory aldehyde compound reacts with the reactive amine compound.

25. The package of claim 24 wherein the amine compound is present in a coating on at least a portion of the interior wall.

26. The package of claim 24 wherein the amine compound is present in the packaging sheet.

* * * * *